United States Patent [19]

Vakhnin et al.

[11] 4,379,592

[45] Apr. 12, 1983

[54] METHOD OF MINING AN OIL-BEARING BED WITH BOTTOM WATER

[76] Inventors: Gennady I. Vakhnin, poselok Yarega, ulitsa Oktyabrskaya, 2, kv. 11; Vladimir G. Verty, poselok Yarega, ulitsa Kosmonavtov, 4, kv. 29; Pavel G. Voronin, poselok Yarega, ulitsa Mira, 4, kv. 6; Evgeny I. Gurov, ulitsa Mira, 2, kv. 3; Vladimir G. Isaikin, ulitsa 30 let Oktyabrya, 3, kv. 49; Vladimir N. Mishakov, ulitsa Pushkinskaya, 1, kv. 4, all of Komi ASSR, Ukhta; Alexandr I. Obrezkov, poselok Yarega, ulitsa Neftyanikov, 1, kv. 14, Komi ASSR; Vitaly S. Sukrushev, poselok Yarega, ulitsa Mira, 2, kv. 12, Komi ASSR, Ukhta; Vladimir P. Tabakov, ulitsa Sofii Kovalevskoi, 4 "A", kv. 125, Moscow; Boris A. Tjunkin, ulitsa Oplesnina, 30, kv. 33; Ljudmila I. Fotieva, poselok Yarega, ulitsa Lermontova, 10, kv. 1, both of Komi ASSR, Ukhta, all of U.S.S.R.

[21] Appl. No.: 223,242

[22] Filed: Jan. 8, 1981

[30] Foreign Application Priority Data

Apr. 17, 1979 [SU] U.S.S.R. ..... 2749653

[51] Int. Cl.[3] ..... E21C 41/10

[52] U.S. Cl. ..... 299/2; 166/50; 166/272

[58] Field of Search ..... 299/2; 166/50, 272

[56] References Cited

U.S. PATENT DOCUMENTS

| | | | |
|---|---|---|---|
| 4,099,783 | 7/1978 | Verty et al. | 299/2 |
| 4,153,297 | 5/1979 | Ridley | 299/2 |
| 4,227,743 | 10/1980 | Ruzin et al. | 299/2 |

*Primary Examiner*—Ernest R. Purser

*Attorney, Agent, or Firm*—McAulay, Fields, Fisher, Goldstein & Nissen

[57] ABSTRACT

A method of mining an oil-bearing bed with bottom water, wherein a plurality of underground workings and at least one working gallery are arranged. Inlet and recovery wells are drilled from the gallery. A heat carrier is force-fed into the oil-bearing bed for heating the latter through the inlet wells. Oil is extracted from the recovery wells to the working gallery and delivered via the workings to the ground surface. While so doing, additional wells are drilled from the working gallery in the water-bearing portion of the bed in the zone of oil contact with bottom water and, simultaneously with the injection of the heat carrier into the inlet wells and extraction of oil from the recovery wells, water is extracted through the additional wells.

2 Claims, 4 Drawing Figures

METHOD OF MINING AN OIL-BEARING BED WITH BOTTOM WATER

BACKGROUND OF THE INVENTION

The present invention relates to the development of oil fields and, more particularly, it relates to a method of oil production by thermal mining and can be used in the petroleum industry.

This invention can be used most efficiently in the development of oil fields characterized by the presence of highly viscous oils and fluid asphalts.

The present invention can also be used for developing oil deposits with depleted reservoir energy.

At present, such deposits cannot be developed efficiently by the conventional method wherein the production of oil is accomplished with the aid of wells drilled from the ground surface. The resulting recovery is rather low.

Known in the art for developing oil fields with highly viscous oils and fluid asphalts is a mining method of oil production without conveying oil-bearing rock to the earth's surface (cf., A.Ya.Krems et al., Shakhtnaiya razrabotka neftianykh mestorozhdenii—The Mining of Oil Deposits, Gostoptekhizdat Publishers, Moscow, 1955).

Said prior art method comprises driving a system of workings at a level of 10-30 m above the roof of the oil-bearing bed. Then, the mine field is divided into several areas in which fringe drifts are driven with drill chambers. From the drill chambers, inclined and straight wells are drilled into the oil-bearing bed according to some pre-selected system. The depth of the wells depends on the thickness of the oil-bearing bed.

The distance between the well faces, the number of wells and the system of driving the workings according to this latter oil production method may differ. The faces are arranged uniformly over the bed floor.

The well design provides for the use of a casing string lowered down to the roof of the oil-bearing bed, while the well face is open, i.e., uncased.

After drilling the wells, oil is recovered therefrom by the flowing method and then by air-lift. When employing the flowing method, oil is lifted through the wells to the drill chambers by reservoir pressure. In the case of air-lift, oil is delivered through the wells to the drill chambers owing to the injection of compressed air to the well face via additional pipes.

From the wells, oil is supplied to ditches provided in the workings. Together with water supplied to the ditches, oil is conveyed to units designed for the separation of oil from the bulk of water. From said units, oil is pumped to central underground oil collectors. Thereupon, following primary preparation and preheat, oil is fed to tanks located on the ground surface.

Said latter prior art method helps increase the recovery by a factor of three and above as compared with development by means of wells drilled from the earth's surface. However, the absolute value of recovery amounts to only about 6%.

Low recovery caused a need to employ mining methods of oil production, involving a physical effect upon an oil-bearing bed and the oil contained therein.

There is also known in the art a method of oil production by thermal mining, involving the exposure of the bed to the effect of steam and heat (cf., V.N. Mishakov et al., Opyt primeneiya teplovykh metodov pri shakhtnoi razrabotke mestorozhdenii vysokoviyazkikh neftei—On the Use of Thermal Methods upon Mining Highly Viscous Deposits, in Neftyanoe khzyaistvo—*Journal of Petroleum Industry, No.* 10, 1974, pp. 31-35).

Said prior art method provides for driving, above the oil-bearing bed, a plurality of underground workings including shafts, shaft workings, drifts and drill chambers.

Form the drill chambers located in the drifts, straight and inclined inlet and recovery wells are drilled. A heat carrier (steam) is delivered to the oil-bearing bed via inlet wells, which drives oil from the inlet wells to the recovery wells. From the face of the recovery wells, oil is air-lifted to the drill chambers.

Said method suffers from inadequate heating of the bottom portion of the bed and, as a result, a reduction of current production of oil, recovery and efficiency of the process of thermal mining of the oil-bearing bed.

According to another prior art method of mining an oil-bearing bed (U.S. Pat. No. 1,634,235), wells are drilled from underground workings located both above and below the oil-bearing bed. Steam treatment of face zones and extraction of oil therefrom is effected from shallow wells drilled from the workings from the top downwards or from the bottom upwards.

The face zone of the wells is heated by way of delivering steam to the well faces via pipes placed in the well while oil is extracted from the same wells.

The use of the latter prior art method in oil deposits with bottom water is disadvantageous in that the oil-bearing bed cannot be drilled from the bottom while the drilling of wells from the top involves a slow development of the oil-bearing bed. Sanding up occurs in the wells, air-lift of oil tends to be rather complicated, all this resulting in low recovery.

Still another prior art mining method of oil production (cf., U.S. Pat. No. 1,520,737) comprises driving a vertical shaft through an oil-bearing bed below which a drill chamber is arranged.

Inclined and ascending wells are drilled in a radial direction from the drill chamber. The method provides for alternate injection of a heat carrier into the oil-bearing bed through said wells and extraction of oil from the same wells following the heating of the oil-bearing bed in the region of the well face zone.

The method further provides for the delivery of a heat carrier (such as steam) via pipes passing through said wells for the purpose of cleaning the well face zone from oxidized oil and resinous substances, as well as for removing the well output. Oil extraction is effected by gravity flow.

The disadvantage of using said method in oil deposits with active bottom water resides in the difficulty of arranging a drill chamber below the oil-bearing bed and drilling rise wells. Under certain conditions, it becomes impossible to utilize said method.

Also known in the art is a method of mining oil deposits (cf., U.S.S.R. Inventor's Certificate No. 199,058), wherein a heat carrier is injected via pipes placed in level, flat-inclined or rise wells and provided near the face with a packer, while the extraction of oil is effected through perforated holes in the casing near the top of the well.

Said latter method suffers from a low rate of heating when used in oil deposits with bottom water.

There is further known a method of mining oil deposits, wherein a heat carrier is injected from workings located above a recovery gallery. The producing bed is heated by periodically injecting steam through a system of inlet wells. Without discontinuing the injection of steam, fluid such as oil and water is periodically extracted, followed by periodic injection of hot and then cold water, while continuing the extraction of fluid via wells of the recovery gallery.

This latter method suffers from slow heating of the bottom portion of the bed, especially so, in deposits with bottom water, and the resulting reduction of recovery and efficiency of the heat effect.

There is likewise known a prior art method of mining an oil deposit, which comprises injecting a heat carrier into the bed with the aid of inlet wells and extracting oil with the aid of recovery wells drilled from a single working gallery.

The latter prior art method suffers from a low rate of heating the bed due to the bottom water pressure when developing an oil deposit with underlying water.

SUMMARY OF THE INVENTION

It is the primary object of the present invention to accelerate the heating of the bed owing to reduced pressure of bottom water.

It is another object of this invention to develop a mining method that would help increase the current production of oil and ultimate recovery.

It is still another object of the present invention to develop a mining method that would help increase the efficiency of the process of heating the oil-bearing bed.

Said and other objects of the present invention are accomplished in the herein disclosed method of mining an oil-bearing bed with bottom water, which comprises:

arranging a plurality of underground workings and at least one working gallery;

drilling inlet and recovery wells from said working gallery;

drilling from said working gallery additional wells to the water-bearing portion of the bed in the zone of oil contact with bottom water;

force-feeding a heat carrier through the inlet wells into the oil-bearing bed for heating the latter to a temperature at which oil assumes desired fluidity in the oil-bearing bed and for displacing oil to the recovery wells;

extracting oil from the recovery wells to the working gallery;

extracting water through said additional wells simultaneously with the injection of the heat carrier into the inlet wells and extraction of oil from the recovery wells; and delivering oil from said working gallery via the workings to the ground surface.

The improvement of the method according to the present invention consists in that additional wells are drilled from the working gallery in the water-bearing portion of the bed in the zone of oil contact with bottom water and, simultaneously with the injection of the heat carrier into the inlet wells and extraction of oil from the recovery wells, water is extracted through the additional wells.

An increased rate of heating the oil-bearing bed is attained owing to reduced pressure of bottom water. In deposits with bottom water, saturated with highly viscous oil, the process of heating the bed is affected by the existing water pressure and greater fluidity of stratal water as compared with oil. When injecting the heat carrier into the bed, said bottom water pressure must to be overcome. Upon reduction of the heat carrier delivery pressure, the heat flux is shifted by the bottom water pressure to the top portion of the bed while the bottom portion of the latter stays less heated or not heated at all.

The heat carrier injected in the bed encounters the back pressure of bottom water and tends to retreat to zones of lower pressure such as (at the first stage of the development) elevated portions of the bed from which oil is extracted in the first place. The effect of bottom water is especially pronounced in highly permeable beds or bed portions, as well as in fissured beds featuring cracks from the bottom of the bed to its roof.

Level or flat-dipping wells drilled into the water-bearing portion of the bed in the zone of water-oil contact make it possible, upon extraction of water from them, to reduce bottom water head, thereby reducing the pressure in the oil-bearing bed.

Recovery wells drilled into the oil-bearing portion of the bed yield oil primarily from the most permeable portions and from cracks if any. In view of a lower pressure of bottom water, these most permeable portions and cracks are penetrated by the heat carrier which promotes the heating of oil and its delivery, owing to the existing pressure difference and force of gravity, to the recovery wells. Heated oil moves over the shaft of recovery wells to promote the heating of the bed over the entire volume thereof.

An increase of the current production of oil and of recovery is attained as a result of heating the oil-bearing bed and oil contained therein and, consequently, as a result of reduced oil viscosity.

The efficiency of the oil production process is ensured due to a more uniform coverage of the bed by the process of oil displacement by the heat carrier as a result of increased recovery and higher rate of mining the oil-bearing bed.

The present invention will be better understood upon considering the following detailed description of an exemplary embodiment thereof, with due reference to the accompanying drawings in which:

DETAILED DESCRIPTION

Figure 1:
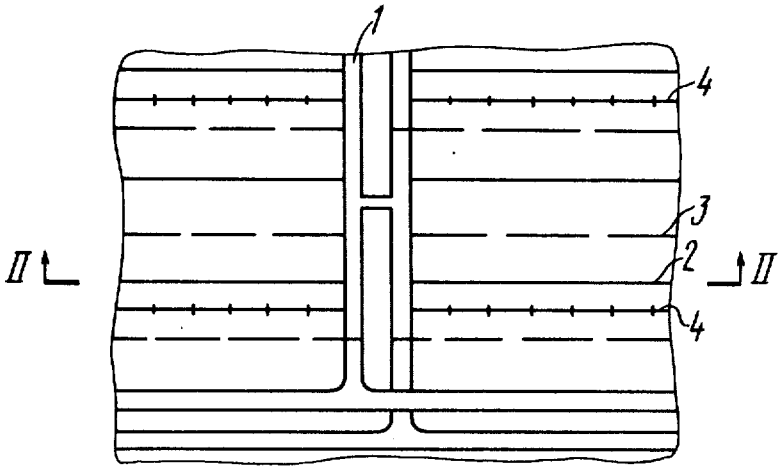
FIG. 1 is a plan view of a rectangular bed portion with workings and wells (the workings and wells are conventionally superposed in a single horizontal plane)
Figure 2:
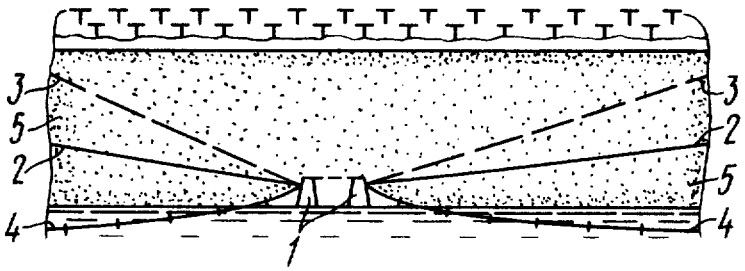
FIG. 2 is a vertical section taken along the line II—II of FIG. 1.

The herein disclosed method is realized in the following manner.

A plurality of underground workings is set up, which includes two shafts, namely, a winding shaft and a ventilating shaft, a mine yard, shaft workings which house a locomotive barn, a pumping station, storages etc. (not shown in the drawings), drifts and inclined workings. The drifts are driven above or below the oil-bearing bed. The inclined workings serve to connect the drifts with a working gallery 1 (FIGS. 1 to 4) located in the bottom portion of the bed.

Inlet wells 2, oil recovery wells 3 and additional water recovery wells 4 are drilled from the working gallery 1 uniformly over the area under development.

Figure 3:
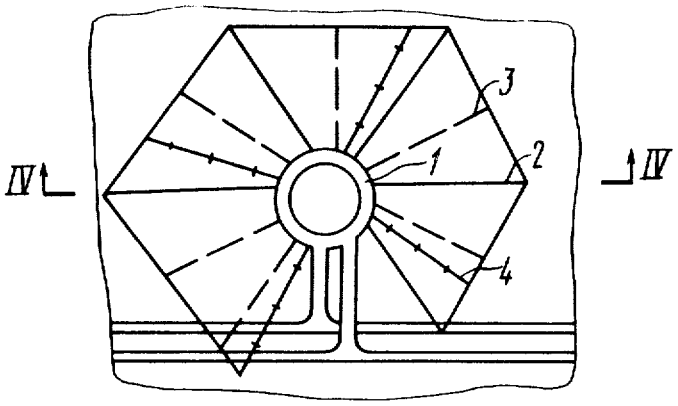
FIG. 3 shows a bed portion of a regular hexagonal shape, with workings and wells (the workings and wells are conventionally superposed in a single horizontal plane)

The areas under development may have the shape of a rectangle or polygon (for example, a hexagon), as shown in FIGS. 1 and 3.

Referring now to FIG. 1, the inlet and recovery wells (2 and 4, respectively) are arranged in plan parallel with each other, while the working gallery 1 is rectilinear.

Figure 4:
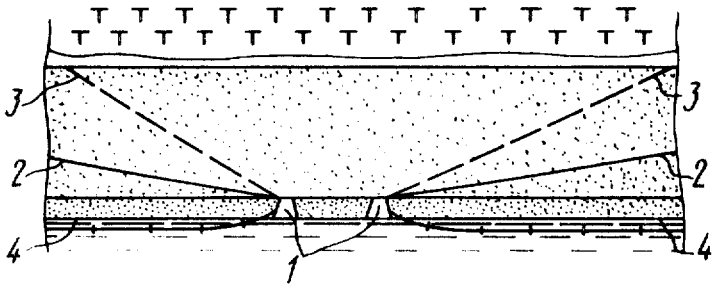
FIG. 4 is a vertical section taken along the line IV—IV of FIG. 3.

The working gallery is located in the bottom portion of the bed. In some cases, it is expedient that the gallery be located in the zone of water-oil contact (FIG. 4).

FIG. 3 shows an oil-bearing bed portion having a regular hexagonal shape. The working gallery 1 is in this case circular while the wells are arranged radially.

The inlet wells 2 and the oil recovery wells 3 are drilled into the oil-bearing bed 5, and the additional water recovery wells 4 are drilled into the water-bearing portion of the bed in the zone of oil contact with bottom water.

The afore-listed wells are arranged uniformly over the area under development. The distances between the oil recovery wells 3 and water recovery wells 4 are not necessarily uniform. In particular, the distance between the water recovery wells may be greater than that between the oil recovery wells.

A heat carrier (for example, steam) is cyclically delivered to the middle portion of the oil-bearing bed 5 via a system of inlet wells 2 under a pressure of from 3 to 20 $kg/cm^2$. Oil is extracted cyclically from the oil recovery wells 3 and water—from the water recovery wells 4.

The cycle duration of the heat carrier injection and oil extraction is 15 to 30 days and depends on the geological characteristic of the oil-bearing bed and flow parameters such as the heat carrier delivery pressure. Stoppages may be of the same duration.

The extraction of water results in a decreased pressure of bottom water, which makes for a more uniform heating of the oil-bearing bed upon the injection of a heat carrier such as steam into the bed. The time required for heating the oil-bearing bed is reduced by 10–30%, which makes for an earlier start of the oil deposit development, higher rate of development and current oil production, as well as for an increase of ultimate recovery.

The present invention can be used no less advantageously for the production of fluid asphalts.

We claim:

1. A method of mining an oil-bearing bed with bottom water, comprising:
   - arranging a plurality of underground workings and at least one working gallery;
   - drilling inlet and recovery wells from said working gallery;
   - drilling from said working gallery additional wells to the water-bearing portion of the bed in the zone of oil contact with bottom water;
   - force-feeding a heat carrier through the inlet wells into the oil-bearing bed for heating the latter to a temperature at which oil assumes desired fluidity in the oil-bearing bed and for displacing oil to the recovery wells;
   - extracting oil from the recovery wells to the working gallery;
   - extracting water through said additional wells simultaneously with the injection of the heat carrier into the inlet wells and extraction of oil from the recovery wells; and
   - delivering oil from said working gallery via the workings to the ground surface.

2. The method of claim 1, wherein the heat carrier is fed under a pressure of from 3 to 20 $kg/cm^2$.

* * * * *